US005142280A

United States Patent [19]

Lehle

[11] Patent Number: 5,142,280

[45] Date of Patent: Aug. 25, 1992

[54] APPARATUS FOR A CONTACT-FREE TRANSMISSION OF ELECTRICAL SIGNALS

[75] Inventor: Erhard Lehle, Muehlheim am Main, Fed. Rep. of Germany

[73] Assignee: D.I.E.N.E.S. Apparatebau GmbH, Muehlheim am Main, Fed. Rep. of Germany

[21] Appl. No.: 399,988

[22] Filed: Aug. 29, 1989

[30] Foreign Application Priority Data

Sep. 7, 1988 [DE] Fed. Rep. of Germany ..... 3830384

[51] Int. Cl.[5] ..... G08C 19/06

[52] U.S. Cl. ..... 340/870.31; 340/870.32

[58] Field of Search ..... 340/870.17, 870.31, 340/870.32, 870.34, 870.38; 324/611; 374/153, 154

[56] References Cited

U.S. PATENT DOCUMENTS 3,268,880 8/1966 Miller ..... 340/870.31 X 3,475,750 10/1969 Howell et al. ..... 340/870.17 X 4,150,358 4/1979 Aviander ..... 340/870.31

FOREIGN PATENT DOCUMENTS 2949075 10/1982 Fed. Rep. of Germany .

*Primary Examiner*—Ulysses Weldon

*Attorney, Agent, or Firm*—Horst M. Kasper

[57] ABSTRACT

In an apparatus for contact-free transmission of condition responsive electrical signals from a rotating machine part to a stationary machine part a single rotational transformer having a stationary primary winding and a rotating secondary winding is used for (a) transmitting power supply signals from a stationary evaluation circuit to a rotating transducer, (b) transmitting condition responsive measuring signals from the transducer to the evaluation circuit, and (c) transmitting synchronizing signals between the transducer and the evaluation circuit.

7 Claims, 3 Drawing Sheets

APPARATUS FOR A CONTACT-FREE TRANSMISSION OF ELECTRICAL SIGNALS

BACKGROUND OF THE INVENTION

1. Field of the Invention

The invention relates to the contact-free or touchless transmission of condition responsive electrical signals from a rotating machine part to a stationary machine part as it may be used for measuring and control of the temperature of a rotating heated or cooled roll in a yarn treating machine.

2. Brief Description of the Background of the Invention Including Prior Art

Apparatus of this type is shown in German patents 29 49 075 and 36 21 397.

German Patent document 2,949,075 teaches an arrangement for contact-free temperature measurement at a rotating machine part. In comparison to this reference, the instant invention does not only disclose an expansion to several temperature resistors and their scanning with the aid of a multiplexer but also the means for synchronization of the scanning of the measurement values on the rotating machine part with signal evaluation on the stationary machine part.

The German Patent document 3,621,397 teaches a heat cylinder with measurement value transmission of several temperature-dependent resistors. A co-rotating scanner scans the resistors. For a transmission, at least three separate transmission devices are required, namely, a first one for the supplying of current to the rotating transformer, a second one for transmitting the temperature signals to the stationary part, and a third one for the synchronization of the rotating scanner by a stationary pulse indicator.

SUMMARY OF THE INVENTION

1. Object of the Invention

It is an object of the invention to provide such apparatus permitting the transmission of several signals originating from different sources such as temperature sensors located at different positions along a heated roll. It is a further object to disclose such apparatus which requires little space, is less complicated than known apparatus but nevertheless is reliable and extremely accurate. According to another object of the invention the apparatus should be easily adjustable and adaptable to different operating conditions of the measuring and/or control system.

These and other objects and advantages of the present invention will become evident from the description which follows.

2. Brief Description of the Invention

The apparatus according to the invention comprises a high frequency (HF) generator and an evaluation circuit at the stationary part of the machine. It includes a condition-to-electrical signal transducer together with a rectifier circuit provided at the rotating part of the machine. A single rotational transfomer inductively couples the stationary HF generator to the rotating transducer and its associated rectifier circuit and simultaneously couples the rotating transducer to the stationary evaluation circuit for contact-free transmission of HF pulses from the HF generator to the transducer and for contact-free transmission of condition responsive signals from the transducer to the evaluation circuit. The transducer comprises a first counter and the evaluation circuit includes a second counter. Both counters are fed with pulses from the HF generator and have the same predetermined counting capacity. At least the first counter delivers an output signal whose amplitude depends on the supply voltage of this counter. The first counter (in the transducer) is supplied with an output voltage $V_B$ of the rectifier circuit. The second counter (in the evaluation circuit) is supplied with a stabilized voltage $V_{STAB}$.

A first comparator in the transducer receives a voltage which depends on the measured condition as well as on the supply voltage $V_B$ and furthermore receives a signal which is the arithmetic average value of the first counter output signal. The output signal of said first comparator generates via a voltage controlled oscillator VCO the reset pulses for both counters, whereas the average output signal of the second counter (in the evaluation circuit) indicates the actual value of the sensed condition.

A second comparator in the evaluation circuit receives at a first input the reset pulses of the transducer from a current transformer provided in the connection lead between the HF generator and the rotational transformer. This second comparator receives at its second input a signal corresponding to the average value of said reset pulse signal and delivers based on the reset pulse of the transducer a reset signal for the second counter in the evaluation circuit. An electronic switch is connected in parallel to the secondary winding of the rotational transformer and is switched on by the reset pulses at the output of the voltage controlled oscillator.

In the transducer several condition responsive resistors are fed with the rectified supply voltage $V_B$ and are connectable to a first input of the first comparator via a multiplexer. For stepping this multiplexer forward a third counter is provided at the control input of this multiplexer, which third counter is stepped forward by the HF pulses and is cleared by the reset pulses. The stepping input of the third counter is connected to the secondary winding of the rotational transformer and its reset input is connected to the output of the rectifier circuit via a coupling capacitor. An example of a rotational transformer is shown in U.S. Pat. No. 3,612,995.

There are various possibilities for synchronizing the evaluation circuit and the transducer. In a first embodiment a switching means is provided in the evaluation circuit for short-time interrupting the HF signals. Said switching means may be controlled by the output signal of a clock generator which simultaneously controls a de-multiplexer for feeding the condition responsive signals, generated in a time-staggered fashion by the evaluation circuit, to one or several control and/or indicating devices. According to another embodiment one of the condition responsive resistors in the transducer has a value differing essentially from all other resistors such that its connection to the first comparator via the multiplexer results in a signal outside the normal range of condition responsive signals which is recognized in the evaluation circuit as a synchronizing signal.

The invention results in a very compact and reliable transducer apparatus requiring only one rotational transformer and not requiring a stabilized power supply in the rotating transducer. Only a two-wire cable, preferably a coaxial cable, is necessary between the stationary portion of the rotational transformer and the evaluation circuit. Readily available integrated circuit components such as counters, multiplexers, de-multiplexers, and comparators are used.

The noval features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
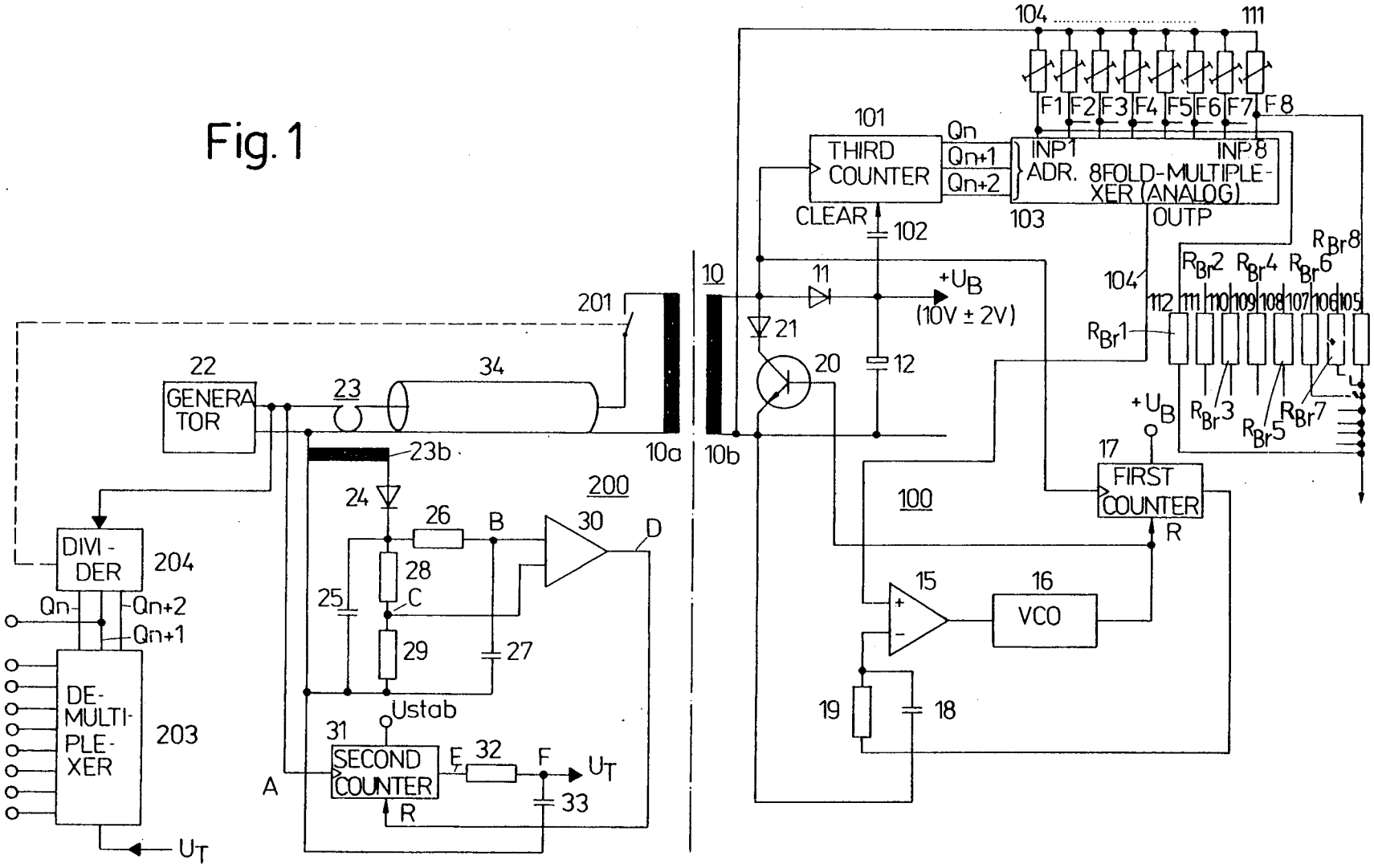
FIG. 1 is a circuit diagram of the apparatus.

The transducer apparatus of FIG. 1 comprises a rotating transducer 100 located on the rotating part of a machine and rotating therewith and further comprises a stationary evaluation circuit 200 provided at the stationary part of the machine, with the transducer 100 and the circuit 200 being coupled via a single rotational transformer 10. This transformer e.g. can transmit a voltage of 10 V and frequencies up to 1 MHz without disturbances.

For feeding power to transducer 100 a HF generator 22 in circuit 200 generates an AC signal of e.g. 1 MHz with any shape of curvature and feeds this AC voltage via a coaxial cable 34 into the primary winding 10*a* of rotational transformer 10. Connected to its secondary winding 10*b* is a rectifier circuit consisting of a diode 11 and a capacitor 12 which rectifier delivers a non-stabilized supply voltage $+U_B$ of about 10 V plus/minus 2 V. With this non-stabilized voltage $+U_B$ the active circuits of the transducer 100 and via the bridge resistors $R_{Br1}$ to $R_{BrB}$ the condition responsive, e.g. temperature responsive, resistor F1 to F8 are supplied with DC power. By means of an 8-input multiplexer 103 these sensor resistors F1 to F8 are subsequently connected to the non-inverting input (+) of a differential amplifier 15 which serves as a first comparator. Its output is connected to an input of a voltage controlled oscillator VCO 16 which delivers a reset signal to the reset input R of a first counter 17. The stepping or counting input of counter 17 is connected to the secondary winding 10*b* of transformer 10 so that this counter after its reset counts a predetermined number of e.g. 64 pulses of the transmitted 1 MHz signal and thereafter stops until the next reset pulse is received. The output of counter 17 is connected to the other end of secondary winding 10*b* via a series circuit consisting of resistor 19 and capacitor 18 which other end simultaneously constitutes the reference potential for the supply voltage $U_B$. This filter circuit 18, 19 generates at the junction of resistor 19 and capacitor 18 an analog signal corresponding to the arithmetic average value of the counter output pulses, which analog signal is fed to the inverting input (−) of differential amplifier 15. Amplifier 15 therewith compares this average value with the condition responsive voltage generated by that one of condition responsive resistors F1 to F8 which just is scanned at this time. If the apparatus is used in a system for controlling the temperature of a heated roll, the condition responsive resistors F1 to F8 are temperature responsive resistors positioned within the roll along its rotational axis. The circuit is self-balancing insofar as the reset signal for counter 17 is generated by differential amplifier 15 and subsequent VCO 16 every time in such a time relation that the differential voltage at the inputs of amplifier 15 disappears. Only in this case the frequency of VCO 16 does no longer change.

The reset signal at the output of VCO 16 is also fed to the base electrode of a transistor 20 which via a diode 21 is connected in parallel to secondary winding 10*b* of transformer 10. With each reset pulse secondary winding 10*b* is short-circuited via transistor 20. A third counter 101 serves for stepping multiplexer 103 forward. Counter 101 receives the 1 MHz pulse sequence from secondary winding 10*b* and after time intervals of 0.2 seconds changes the bit pattern at its outputs $Q_n$ to $Q_{n+2}$ and therewith subsequently addresses the measuring signal inputs of multiplexer 103. As a result of this addressing the concerned condition responsive resistor F1 to F8 is connected to lead 104 leading to the non-inverting input (+) of amplifier 15. Each time a resistor F1 to F8 is connected into the measuring circuit as described above the analog measuring voltage is converted into an associated frequency of VCO 16. With this frequency on the one side first counter 17 is reset and on the other side secondary winding 10*b* is short-circuited. Each short-circuit of secondary winding 10*b* results in a pulse being induced in primary winding 10*a*, so that this primary winding delivers a pulse sequence corresponding to the rhythm of the reset signals of counter 17 which is the frequency of VCO 16. Evaluation circuit 200 therefore receives a frequency which depends on the measured temperature or other physical condition. This frequency is fed for further processing into evaluation circuit 200 via current transformer 23.

Figure 4:
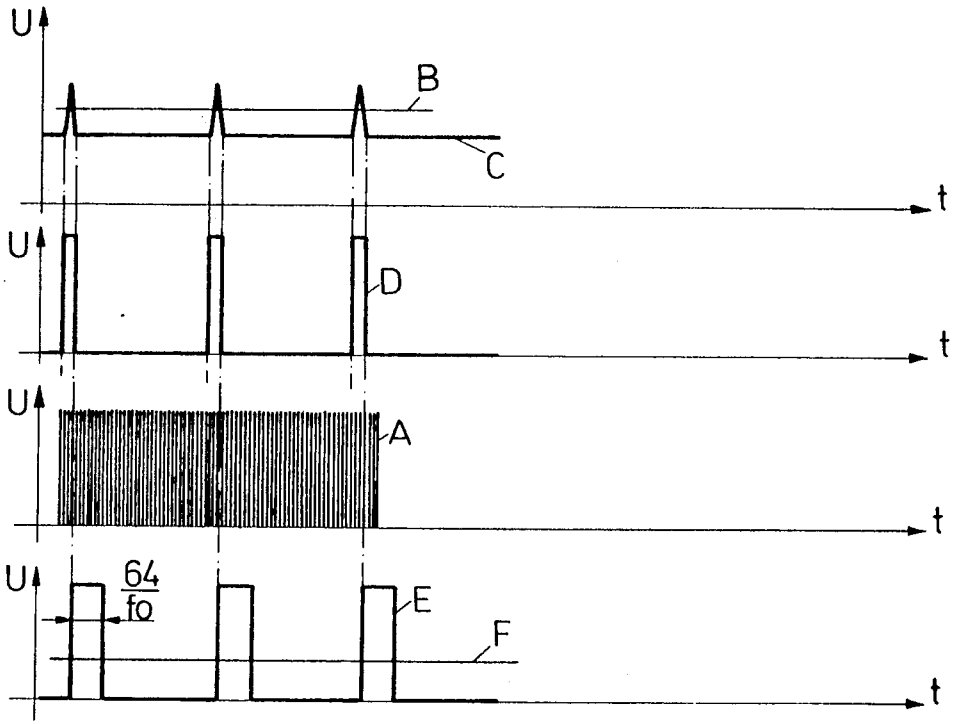
FIG. 4 shows signals at various circuit nodes in FIG. 1.

The pulses at the secondary winding 23*b* of current transformer 23, having a frequency identical with the frequency of the reset pulses, are rectified by means of a diode 24 and this DC voltage is smoothened by filter capacitor 25. This DC signal at capacitor 25 one the one side is supplied to voltage divider 28, 29 whose junction C is connected to the non-inverting input (+) of differential amplifier 30 serving as a second comparator. On the other side a series circuit consisting of a resistor 26 and a capacitor 27 is connected in parallel to storage capacitor 25 with junction B of this series circuit being connected to the inverting input (−) of amplifier 30. Junction C therewith provides the rectified voltage signal whereas junction B provides the average value of said rectified voltage signal. From FIG. 4 the following operation can be seen: Each time when a reset pulse of transducer 100 is transmitted to the primary winding 10*a* of transformer 10 the current pulse C at the non-inverting input (+) of amplifier 30 will exceed the average value B at the inverting input. In this case amplifier 30 generates at its output D a reset pulse for the second counter 31. The count input A of this second counter 31 receives the 1 MHz pulse sequence from generator 22. Counter 31 counts a predetermined number of e.g. 64 pulses. It is supplied with a stabilized voltage $V_{STAB}$, which can be generated in the stationary portion of the apparatus without difficulties. The pulses at output E of second counter 31 are fed to a RC filter network consisting of a resistor 32 and a capacitor 33. This network is connected between output E and reference potential. It delivers an analog average value of the output pulse sequence of counter 31. This average value $U_T$ is available at output F of filter network 32, 33 and is a voltage dependent on the measured condition, e.g. temperature.

Since counter 31 in the evaluation circuit 200 is operated with a stabilized supply voltage $U_{STAB}$, this counter delivers output pulses of constant amplitude. The average value of the output pulse sequence therefore only depends on the frequency of said pulse sequence. Counter 17 within transducer 100, however, is operated with a non-stabilized supply voltage $U_B$, so that there the average value of the output signal depends on the frequency of the reset pulses and on the supply voltage $U_B$. For both counters 17 and 31 integrated circuit counter modules, e.g. C-MOS counters, are used, the output amplitude of which depends on the supply voltage.

When multiplexer 103 subsequently scans different measuring resistors F1 to F8 a subsequent series of analog voltages appears at output F of evaluation circuit 200 which voltages originate from different measuring points. This series of analog voltages now has to be distributed in the same rhythm to different temperature controllers or to different inputs of a common temperature controller or to different temperature monitoring instruments or other user means. This distribution of the analog output signals $U_T$ is achieved by means of a de-multiplexer 203 which is part of the evaluation circuit 200 or part of an associated multiple-temperature controller. A divider 204 controls the forward stepping of de-multiplexer 203 and furthermore periodically opens electronic switch 201 at time intervals of 8=1.6 sec. for a short period of 10 msec. By this opening of switch 201 the transmission of the 1 MHz signal to the secondary winding 10*b* of transformer 10 is interrupted and supply voltage $U_B$ breaks down. As soon as switch 201 is closed again voltage $U_B$ builds up again and derived from the leading edge of this re-established supply voltage a clearing signal reaches the reset input of third counter 101 via coupling capacitor 102. Counter 101 again starts counting and stepping multiplexer 103 forward. The short-time short-circuiting of secondary winding 10*b* by the output signal of VCO 16 via transistor 20 does not result in a resetting of counter 101 because such short-time voltage interrups are bridged-over by storage capacitor 12 so that no reset pulse is fed to counter 101 via coupling capacitor 102. Since divider 204 operates switch 201 for controlling multiplexer 103 and simultaneously steps forward de-multiplexer 203 the required synchronization of transducer 100 and evaluation circuit 200 is accomplished.

In the shown embodiment such synchronization is initiated by evaluation circuit 200. Instead of this such synchronization can be initiated by transducer 100. For this purpose one of the measuring signal inputs of multiplexer 103 has connected thereto a resistor which generates a signal lying essentially outside the normal signal range generated by condition responsive resistors F1 to F8. If such out-of-range signal is transmitted to the primary winding 10*a* of transformer 10 it will be recognized by the evaluation circuit as a synchronization signal and can be used for synchronizing de-multiplexer 203.

Figures 2A, 2B, 2C, 3A, 3B, 3C:
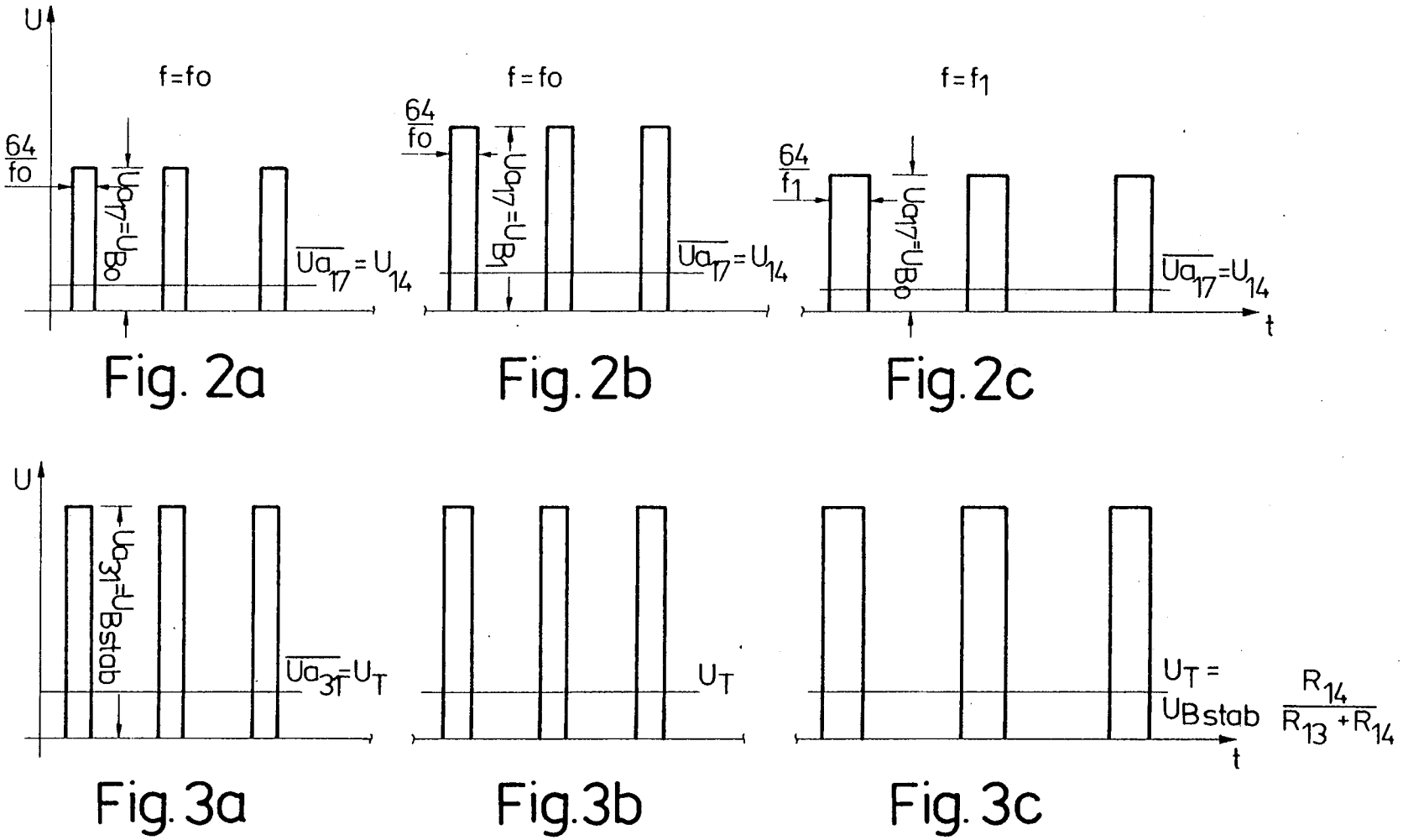
FIGS. 2*a* to 2*c* show signal curves for explaining how the influence of changes of the supply voltage and/or the frequency on the function of the rotating transducer is compensated.
FIG. 3*a* to 3*c* show corresponding signal curves in relation to the stationary evaluation circuit.

With reference to FIGS. 2 and 3 the compensation of any fluctuations of the non-stabilized supply voltage $V_B$ for transducer 100 and the compensation of any changes of the frequency f of HF generator 22 will be explained. This explaination is given under the assumption that the value of the just measured temperature remains constant and therefore the output voltage $U_T$ should remain unchanged as well. The normal set-point value of the supply voltage $V_b$ might be $U_B=U_{BO}$ and the normal frequency of the HF generator output signal might be $f=f_0$. This normal condition is shown in FIG. 2*a*. The voltage $U_{17}$ at the output of counter 17 here has the value $U_1$. If the amplitude of voltage $U_B$ increases as this is shown in FIG. 2*b*, then the voltage drop across sensor resistor F increases as well, but simultaneously the output voltage $U_{17}$ of counter 17 increases also, because it is supplied with the same supply voltage $U_B$. Both increased voltages are fed to differential amplifier 15 so that its differential output voltage remains unchanged. VCO 16 receives an unchanged control voltage determining its output frequency. VCO 16 therefore generates the same frequency as in the normal case with $U_B=U_{BO}$. Since counter 31 in the evaluation circuit 200 is operated with a stabilized supply voltage $U_{STAB}$, output F delivers the same condition responsive signal as in the normal case, see FIGS. 3*a* and 3*b*.

If the frequency f of HF generator 22 is decreased from a normal value of $f_0$ to a reduced value $f_1$, as this can be seen when comparing FIGS. 2*a* and 2*c*, then counter 17 needs more time for counting e.g. 64 pulses. Accordingly, the output pulse of FIG. 2*c* is broadened from $64/f_0$ to $64/f_1$. A broadened output pulse as such would result in an increased average value of the counter output signal. Since, however, with an unchanged supply voltage $U_B$ the measuring voltage across the sensor resistor F remains unchanged and is compared against said average value by differential amplifier 15, the output of amplifier 15 delivers a changed control voltage to VCO 16. This changed control voltage shifts the reset pulse in such a way that the interval between two pulses is also broadened in accordance with the broadening of the pulse. Therewith the average value of the counter 17 output signal $U_{17}$ is not changed. The average value of $U_{17}$ therefore only depends on the voltage drop across condition responsive resistor F. The reset pulse, as mentioned above, is transmitted to evaluation circuit 200. Therefore the interval between two pulses is broadened there in the same manner as the pulses themselves are broadened. In view of the stabilized supply voltage $V_{STAB}$ the average value $U_T$ generated by integrating network 32, 33 keeps its value because any broadening of the pulses is compensated by a corresponding broadening of the interval between two pulses. The accuracy of the transducer apparatus neither depends on a constant amplitude of the non-stabilized supply voltage $U_B$ for the rotating transducer 100 nor depends on a constant frequency of the HF generator 22 in the stationary evaluation circuit 200. During tests of the shown embodiment this frequency could be changed between 500 and 1500 kHz without impairing the accuracy of the apparatus. Also, a change of the non-stabilized supply voltage $U_B$ for the rotating transducer 100, e.g. caused by changing the coupling between the primary winding and the secondary winding of transformer 10, did not alter the measuring result. Since the transmission of the measuring signal finally is based on the counting of pulses the length of cable 34 does not influence the accuracy of the apparatus. Instead of a counter 17 having an output signal amplitude depending on the value of the supply voltage $U_s$ a constant output amplitude counter could be used together with a subsequent signal level converter or amplifier whose output signal depends on its supply voltage. Further modifications of the shown embodiment can be made by persons skilled in the art without departing from the scope of the invention as defined by the attached claims.

I claim:

1. An apparatus for the contact-free transmission of a plurality of condition-responsive electrical signals from a rotating machine part to a stationary machine part, said apparatus comprising:

a) a first transformer including a stationary winding for being supported by the stationary machine part and a rotating winding for being fixed to the rotating machine part, said stationary winding and said rotating winding being inductively coupled to each other;

b) a high frequency generator and evaluation circuit means both for being supported by the stationary machine part;

c) transducer means including a rectifier circuit for being fixed to the rotating machine part, said rotating machine part further carrying a plurality of condition-responsive sensors for generating said plurality of condition-responsive electrical signals, wherein the rectifier circuit comprises;

d) first means connecting an output of said high frequency generator to said stationary winding;

e) second means coupling said evaluation circuit means to said stationary winding;

f) third means connecting an input of said rectifier circuit to said rotating winding; with said transducer means including:

g) first counting means having a first supply voltage terminal, a first input, a first output and a first reset terminal, with said first supply voltage terminal being connected to a storage capacitor provided at the output of said rectifier circuit, and said first input of said first counting means being connected to said rotating winding;

h) multiplexer means having a plurality of signal inputs, at least one control input, and an output with said signal inputs being connected to said condition-responsive sensors;

i) first comparator means having a first input (+) and a second input (−) and an output, with said first input being connected to the output of said multiplexer means and said second input being connected to said first output of said first counting means;

j) third counting means having a third input, at least one output and a third reset terminal, with said third input of said third counting means being connected to said rotating winding, that said at least one output being connected to at said least one control input of said first multiplexer means, and said third reset terminal being coupled to said output of said rectifier circuit;

k) a voltage-controlled oscillator having a second control input and an output with said second control input being connected to the output of said first comparator means and said oscillator output being connected to the first reset terminal of said first counting means;

l) an electronic switch having its switching path connected across said rotating winding and having a control electrode connected to said output of said voltage-controlled oscillator; and said stationary evaluation circuit means including:

m) second counting means having a second supply voltage terminal, a second input, a second output, and a second reset terminal, with said second supply voltage terminal being connected to a source of stabilized supply voltage, said second input of said second counting means being connected to said output of said high frequency generator, whereat said first and second counting means have the same counting capacity;

n) diode means in series with a voltage divider circuit connected to said means for coupling said evaluation circuit means to said stationary winding, wherein said voltage divider circuit comprises a tab;

o) a first integrating network having an input connected across said voltage divider circuit and having an output;

p) second comparator means having a first input (+), a second input (−) and an output, with said first input being connected to the output of said first integrating network, said second input being connected to the tab of said voltage divider circuit and having the output connected to said second reset terminal of said second counting means;

q) a frequency divider circuit having an input connected to an output of said high frequency generator and having a switching output and at least one control output;

r) switching means connected between said output of said high frequency generator and said stationary winding, said switching means having a third control input connected to the switching output of said frequency divider circuit; and s) demultiplexer means having a signal input, at least one control input and a plurality of signal outputs, with said at least one control input being connected to said at least one control output of said frequency divider circuit and said signal input being in communication with the signal output of said second counting means.

2. The apparatus of claim 1, whereat an input of a second integrating network is connected to said first output of said first counting means and an output of said second integrating network is connected to said second input of said first comparator means.

3. The apparatus of claim 1, whereat an input of a third integrating network is connected to said second output of said second counting means and an output of said third integrating network is connected to a signal input of said demultiplexer means.

4. The apparatus of claim 1, whereat a diode is connected in series with said switching path of said electronic switch across said rotating winding.

5. The apparatus of claim 1, whereat a coupling capacitor is connected between said output of said rectifier circuit and the third reset terminal of said third counting means.

6. The apparatus of claim 1, whereat said second means for coupling said evaluation circuit means to said stationary winding is a current transformer, having a primary winding and a secondary winding.

7. The apparatus of claim 1, further including a capacitor connected across said voltage divider circuit.

* * * * *